United States Patent [19]

Voornas

[11] Patent Number: 4,741,494

[45] Date of Patent: May 3, 1988

[54] UNIVERSAL GARBAGE CAN HOLDER

[76] Inventor: Nicholas M. Voornas, 5 John Dr., Hawthorn Woods, Ill. 60047

[21] Appl. No.: 102,888

[22] Filed: Sep. 30, 1987

[51] Int. Cl.[4] ..... A47G 23/02

[52] U.S. Cl. ..... 248/154; 211/71; 248/121; 248/147; 248/156; 248/DIG. 7

[58] Field of Search ..... 248/154, DIG. 7, 121, 248/147, 311.2, 146, 156; 211/71, 89

[56] References Cited

U.S. PATENT DOCUMENTS

| | | | |
|---|---|---|---|
| 3,028,134 | 4/1962 | Nolen . | |
| 3,091,342 | 5/1963 | Crump . | |
| 3,173,547 | 3/1965 | Alissandratos | 248/DIG. 7 X |
| 3,224,717 | 12/1965 | Mott | 248/147 |
| 3,235,119 | 2/1966 | Smith . | |
| 3,239,175 | 3/1966 | Seibel . | |
| 3,306,486 | 2/1967 | Martino et al. . | |
| 3,820,750 | 6/1974 | Deike . | |
| 4,069,997 | 1/1978 | Weiss | 248/DIG. 7 X |
| 4,124,185 | 11/1978 | Preisinger . | |
| 4,331,310 | 5/1982 | Silva et al. . | |
| 4,527,695 | 7/1985 | Arms | 211/71 |

FOREIGN PATENT DOCUMENTS

| | | | |
|---|---|---|---|
| 0493066 | 5/1953 | Canada | 248/DIG. 7 |

*Primary Examiner*—Ramon O. Ramirez

*Attorney, Agent, or Firm*—Henderson & Sturm

[57] ABSTRACT

A universal garbage can holder of a type having a sleeve adapted to be buried in the ground for slidably and removably receiving a post of wood or the like. First and second semi-rigid strips of metal or the like are provided so that one end of each strip will extend around one side of a garbage can. The other ends thereof are attached to an upper portion of the post. The semi-rigid strips are somewhat bendable so that they can be bent to adjust to garbage cans of various sizes.

1 Claim, 1 Drawing Sheet

UNIVERSAL GARBAGE CAN HOLDER

TECHNICAL FIELD

The present invention relates generally to garbage can holders, and more particularly to a garbage can holder which is adjustable to accommodate garbage cans of various sizes without major modification to the device and also to a garbage can holder with a removable support post.

BACKGROUND ART

A common problem with the use of garbage cans in an outside area is keeping them upright and where they belong. For example, it is not uncommon that garbage cans are tipped over by wind and storms, by dogs or by vandals.

The aforementioned problem has been addressed before, for example, as shown in U.S. Pat. Nos. 3,091,342 to Crump and 4,331,310 to Silva. In these two patents a permanent installation has been provided and the clamping mechanism is not adjustable to accommodate garbage cans of various sizes and shapes, and is not removable. For example, the post 6 of the Crump device is embedded in concrete in the ground and is designed to be in place permanently. While this is quite acceptable if the garbage can pickup service will pickup the garbage in the back of the house or at some place where the garbage cans do not detract from the aesthetics of the home, but where garbage pickup service is curbside at the front of the house, then the garbage cans are hardly ever kept there on a regular basis, but are moved curbside on the front of the house only on the day of designated garbage pickup. It is abundantly clear that most consumers would not desire to have a permanent installation of the Crump structure in their front yard because it would detract from the aesthetics of their home.

U.S. Pat. No. 3,239,175 to Seibel discloses a container clamp which is adjustable, but the adjustment is not through a large enough range to accommodate all of the garbage cans available and furthermore, the Seibel structure is too complex to economically be used for garbage cans. In actuality, it is designed more for retaining oil drums, barrels and other similar structures.

Accordingly, there is a need for a universal garbage can holder which is adjustable, removable and economical to produce.

DISCLOSURE OF THE INVENTION

The present invention relates generally to a universal garbage can holder of a type having a sleeve adapted to be buried in the ground for slidably and removably receiving a 2×4 post of wood or the like. First and second semi-rigid strips of metal or the like are provided so that one end of each strip will extend around one side of a garbage can. The other ends thereof can be attached to an upper portion of the post. The semi-rigid strips are somewhat bendable so that they can be bent to adjust to garbage cans of various sizes.

An object of the present invention is to provide an improved garbage can holder.

Another object of the present invention is to provide a garbage can holder which is highly universal to accept garbage cans of many different sizes.

A further object of the present invention is to provide a universal garbage can holder which permits a vertical post to hold the garbage can as needed, but which is removable for aesthetic purposes so that the apparatus can be used in front of a home on designated garbage pickup days only.

Other objects, advantages, and novel features of the present invention will become apparent from the following detailed description of the invention, when considered in conjunction with the accompanying drawings.

BEST MODE FOR CARRYING OUT THE INVENTION

Figure 4:
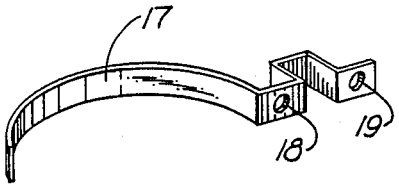
FIG. 4 is a perspective view of a semi-rigid garbage can holding strip.
Figure 1:
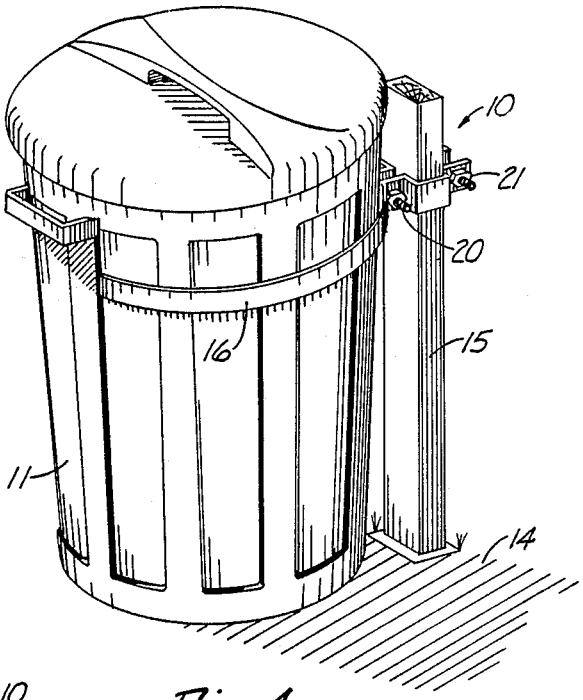
FIG. 1 is a perspective view of a preferred embodiment of the present invention shown holding a garbage can.

Referring now to the drawings, wherein like reference numerals designate identical or corresponding parts throughout the several views, FIG. 1 shows a universal garbage can holder (10) constructed in accordance with the present invention holding a garbage can (11). A plastic sleeve (12) having ground engaging flanges (13) on the top thereof is provided so that it can be buried in the earth (14). The cross sectional shape and size of this sleeve (12) is rectangular and slightly larger than the size of a common standard two inch by four inch piece of wood which will be referred to herein as a post (15).

A first strip of semi-rigid material, such as galvanized sheet steel (16) has an identical counter part (17) on the opposite side of the post (15). One end of each of the strips (16 and 17) extend around the garbage can (11) and the other end of the metal strip (16 and 17) are bolted together and clamped around the post (15) as can readily be seen in FIG. 2. Aligned openings (18 and 19) as shown in metal strip (17), aligns with identical holes in the member (16), which is identical to (17) in all respects. Nut and bolt fasteners (20 and 21) extend through the aligned openings (18 and 19) in the semi-rigid strips (16 and 17) and are tightened down so that the members (16 and 17) will not slide up or down on the post (15) unless they are loosened and moved to a desired position and then retightened. Such loosening and retightening may sometimes be necessary or desirable when smaller or larger garbage cans are utilized.

Figure 2:
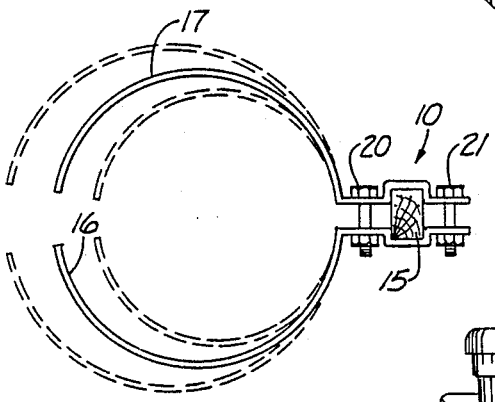
FIG. 2 is a top plan view of the preferred embodiment shown in solid lines and showing in dashed lines how the metal strips on each side thereof can be bent to conform to garbage cans of various sizes.
Figure 5:
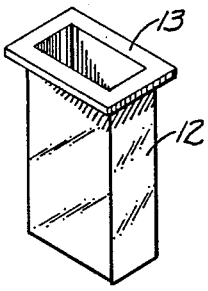
FIG. 5 is a perspective view of a post-holding sleeve to be buried in the ground.

Referring to FIG. 2, it is noted that the semi-rigid strips can be bent outwardly to accept garbage cans larger than the garbage can (11) shown in FIG. 1, or they can be bent inwardly to the dashed lines shown in FIG. 2 which are inwardly from the strips (16 and 17) when smaller garbage cans are to be held.

Figure 3:
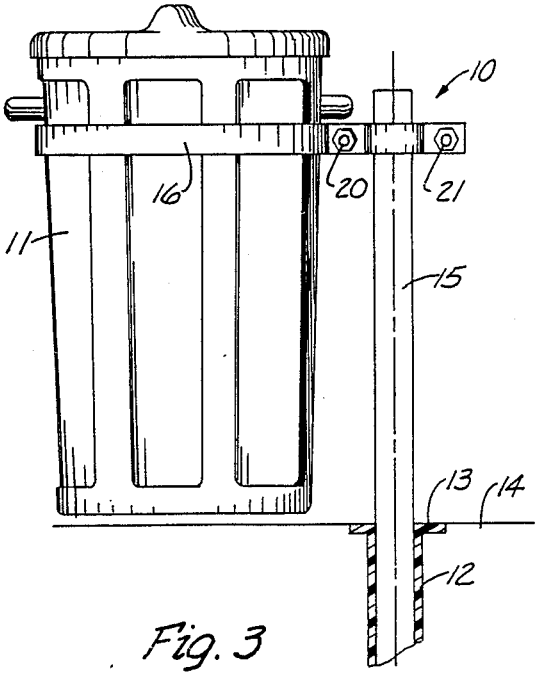
FIG. 3 is a side elevational view of the present invention.

In operation, the sleeve (12) can be installed in the ground (14) by first digging a hole, inserting the sleeve (12) and then filling in around the sleeve (12). During those times when it is desired to hold the garbage can (11) and prevent it from being tipped over by wind, dogs, vandals or the like, the structure (10) shown in FIG. 2 can be utilized and the post (15) slid down into the sleeve (12) as shown in FIG. 3. The garbage can (11) can then be placed between the strip (16 and 17) from the top. The garbage can as shown in FIG. 3, is shown slightly up off the ground (14), but it can be utilized such that the garbage can rests on the ground (14) and is merely held from being tipped over by the strip (16 and 17).

Consequently, the garbage can (11) can be provided for the disposal of the garbage pickup service without fear of it being tipped over by the forces mentioned above, and furthermore, once the garbage has been emptied out of the garbage can (11), the empty garbage can (11) will not be blown around the neighborhood as is often the case after the heavy garbage has been emptied therefrom.

When the homeowner returns at the end of the garbage pickup day, the garbage can (11) and the entire universal garbage can holder can be removed and placed in some inconspicuous place. Of course, a second sleeve (12) could be placed behind the home or at some other place for storage of the garbage can when it is not desired to place it curbside at the front of the house.

Accordingly, it will be appreciated that the preferred embodiment disclosed herein does indeed accomplish the aforementioned objects. Obviously, many modifications and variations of the present invention are possible in light of the above teachings. It is therefore to be understood that, within the scope of the appended claims, the invention may be practised otherwise than as specifically described.

I claim:

1. A universal garbage can holder comprising:

a sleeve adapted to be buried in the ground, said sleeve having means for forming hollow portion formed about a longitudinal axis, said hollow portion being of a non-circular shape in cross-section;

a post slidably disposed within said the hollow portion of said sleeve, said post having a cross-sectional shape and size substantially the same as said non-circular cross-sectional shape of the hollow portion of said sleeve, said post having a longitudinal axis coincident with the longitudinal axis of said hollow portion of the sleeve when the post is disposed in said sleeve, whereby said post can be selectively slid into or out from said sleeve and thereby preventing said post from rotating abouts its longitudinal axis when the post is disposed in said sleeve; and garbage can holding means attached to an upper portion of said post for selectively holding a garbage can to prevent it from being tipped over or being moved laterally, said garbage can holding means including:

a first semi-rigid strip means, one end of said first strip means being at least partially arcuate in shape for abutment with one side of a garbage can, the other end of said first strip means having a non-arcuate portion thereon extending in abutment with three sides of said upper portion of the post, said first semi-rigid strip means having a first hole disposed between said arcuate one end thereof and the non-arcuate portion thereof and a second hole in the other end of said first strip means on the opposite side of said non-arcuate portion thereof from said first hole;

a second semi-rigid strip means, one end of said second strip means being at least partially arcuate in shape for abutment with the other side of a garbage can, the other end of said second strip means having a portion extending in abutment with at least three sides of said upper portion of the post, said second semi-rigid strip means having a first hole disposed between said arcuate one end thereof and the non-arcuate portion thereof, said first hole of said second strip means being in alignment with the first hole in said first strip means, and a second hole being disposed in the other end of said second strip means on the opposite side of said non-arcuate portion thereof from said first hole in the second strip means, said second hole in the second strip means being in alignment with the second hole in the first strip means;

first fastener means extending through the first hole in the first strip means and through the first hole in the second strip means for holding the first and second strip means to said post; and second fastener means extending through the second hole in the first strip means and the second hole in the second strip means for further holding the first and second strip means to said post.

* * * * *